United States Patent [19]

Dobkin et al.

[11] Patent Number: 4,843,302

[45] Date of Patent: Jun. 27, 1989

[54] NON-LINEAR TEMPERATURE GENERATOR CIRCUIT

[75] Inventors: Robert C. Dobkin; Carl T. Nelson, both of San Jose, Calif.

[73] Assignee: Linear Technology, Milpitas, Calif.

[21] Appl. No.: 189,479

[22] Filed: May 2, 1988

[51] Int. Cl.[4] ..... G05F 3/08

[52] U.S. Cl. ..... 323/312; 323/907

[58] Field of Search ..... 323/312, 907

[56] References Cited

U.S. PATENT DOCUMENTS

| | | | |
|---|---|---|---|
| 3,781,648 | 12/1973 | Owens | 323/907 |
| 4,059,793 | 11/1977 | Ahmed | 323/313 |
| 4,061,959 | 12/1977 | Ahmed | 323/313 |
| 4,313,082 | 1/1982 | Neidorff | 323/312 |
| 4,347,476 | 8/1982 | Tam | 323/907 |
| 4,554,503 | 11/1985 | Kasperkovitz | 323/907 |
| 4,652,144 | 3/1987 | Gunther et al. | 323/907 |

*Primary Examiner*—Patrick R. Salce
*Assistant Examiner*—Jeffrey Sterrett
*Attorney, Agent, or Firm*—Flehr, Hohbach, Test, Albritton & Herbert

[57] ABSTRACT

A non-linear temperature correction circuit is provided which utilizes, in one embodiment, a pair of semiconductor elements such as a pair of transistors electrically connected to a common biasing current having a negative temperature coefficient and a negative temperature coefficient voltage is applied between the bases of the transistors. The output of one of the transistors is a non-linear output current which is non-linear with respect to temperature and where the output current has an inflection point.

9 Claims, 2 Drawing Sheets

NON-LINEAR TEMPERATURE GENERATOR CIRCUIT

BACKGROUND OF THE INVENTION

The present invention relates in general to a curvature correction circuit. More particularly, the present invention relates to a non-linear temperature sensistive generator circuit which generates an output current which is non-linear with respect to temperature.

Many types of integrated circuits provide an output having either a specific relationship with respect to temperature or which are supposed to be independent with temperature. Normally, it is desired that the outputs of such integrated circuits be well-controlled functions, and it is often necessary to provide a current or voltage that has a non-linear relationship with respect to temperature.

The purpose of such non-linear currents can be for either curvature correction to improve the linearity of a voltage reference with respect to temperature changes, or to add specific non-linearities to the current or voltage that is being output from the device.

Prior art circuits have achieved curvature correction using relatively complicated circuitry such as a breakpoint method. Problems with such prior art approaches are that the relative complexity can be undesirable from both operational and economic viewpoints.

SUMMARY OF THE INVENTION

It is an object of the present invention to provide an improved non-linear temperature generator circuit.

It is another object to provide a non-linear temperature correction circuit which is extremely simple in terms of components.

It is still another object to provide a non-linear temperature correction circuit that has a relatively high percentage of current that is non-linear in terms of the total output current.

Briefly, the non-linear temperature correction circuit according to the present invention includes, in one preferred embodiment, a pair of semiconductor elements such as a pair of transistors where each of the transistors includes a collector, a base and an emitter.

The pair of transistors are electrically connected to a common biasing current having a negative temperature coefficient. A negative temperature coefficient voltage is applied between the bases of the transistors so as to generate a non-linear output current with respect to temperature from one of those transistors where the output current has an inflection point.

In another preferred embodiment, a transistor and a diode could be utilized, rather than a pair of transistors.

Other objects, features and advantages of the present invention will become apparent from the following detailed description when taken in conjunction with the accompanying drawings.

DETAILED DESCRIPTION OF THE INVENTION

Figure 1:
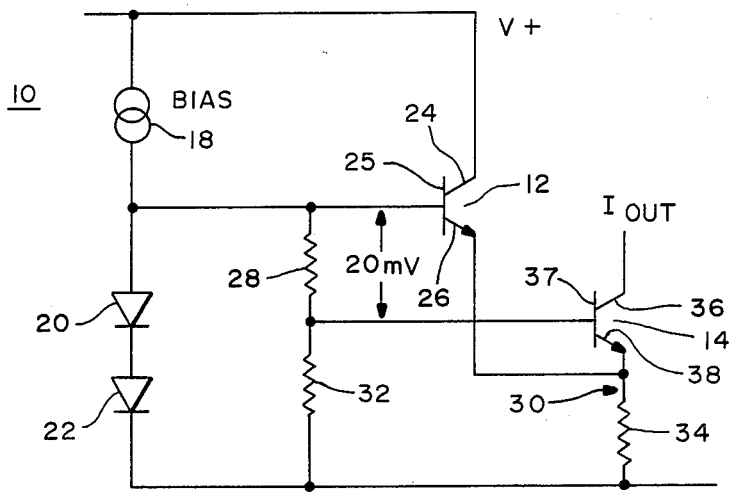
FIG. 1 depicts a preferred embodiment of a non-linear temperature generation circuit according to the present invention.

Referring now to FIG. 1, one preferred embodiment of the present invention is depicted therein.

In FIG. 1, the non-linear temperature generation circuit 10 is a temperature sensitive circuit which includes a pair of bipolar transistors 12, 14 where each of the transistors includes a base, collector and emitter.

Transistor 12 includes collector 24, base 25 and emitter 26. Similarly, transistor 14 includes collector 36, base 37 and emitter 38.

A suitable bias current source 18 and voltage V+ provides an appropriate voltage to base 25 of transistor 12, and to base 37 of transistor 14 through resistor 28. Resistors 32, 34 provide a suitable voltage divider network.

The circuit depicted in FIG. 1 is exceptionally simple and has distinct advantages over other types of curvature correction circuits, as will be described in conjunction with FIG. 2.

In FIG. 1, transistors 12, 14 are electrically interconnected through emitters 26, 38 through common connection 30. Diodes 20, 22 generate a suitable negative temperature coefficient. The bias voltage between bases 25, 37 is desirably about 20 millivolts (mV) for an inflection point at 25° C., although a suitable voltage range could be between 15 and 30 mV.

Figure 2:
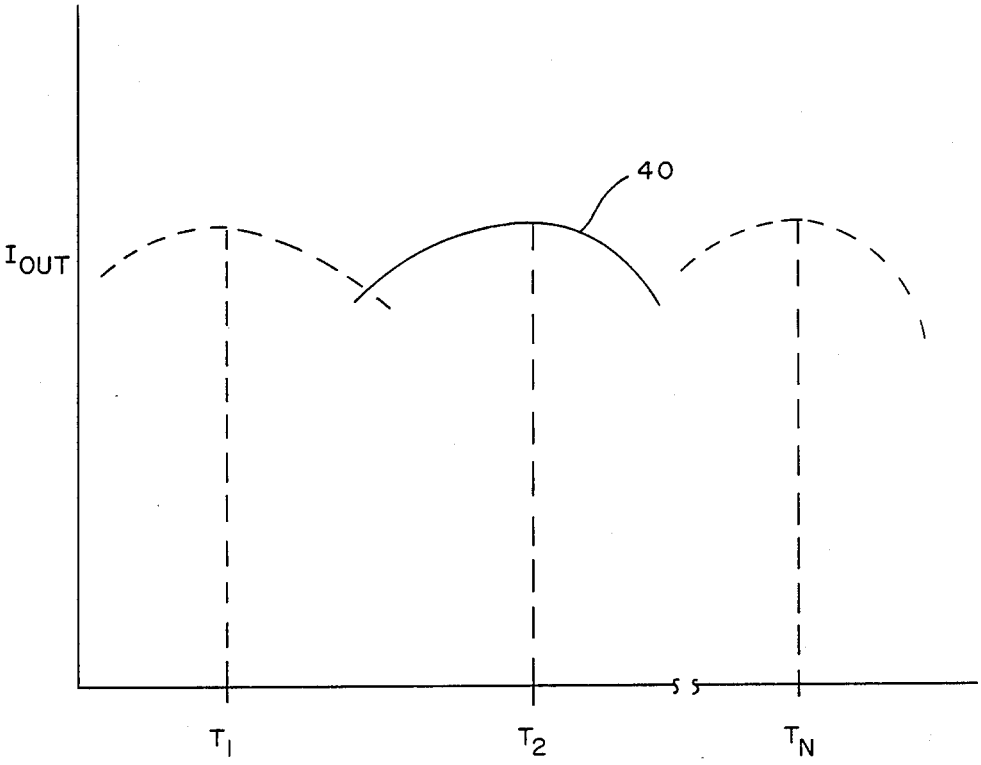
FIG. 2 depicts a graph illustrating the non-linear characteristics of the circuit of FIG. 1 with respect to temperature.

As depicted in FIG. 2, the voltage across the bases 25, 37 sets the temperature of the inflection point. For example, by applying a suitable negative temperature coefficient voltage to set the desired temperature, the inflection point depicted in FIG. 2 can occur at any desired point, such as $T_1, T_2, \ldots, T_N$.

As depicted in FIG. 2, the present invention provides a temperature sensitive circuit where the output current is a non-linear current with respect to temperature and where the output current has a certain inflection point, depending upon the voltage applied to the bases of the transistors. Again, the inflection point could be set at any desired point, as depicted in FIG. 2.

The output current from collector 36 of circuit 10 of FIG. 1 has an inflection point within the range of −55° C. to 150° C. This means that a curved output can be obtained having this flat spot or inflection point, such as depicted in FIG. 2. This permits the present invention to have a minimum influence at a particular temperature. Other types of prior art curvature circuitry have associated with the output a linear temperature coefficient that must be removed by additional circuitry.

The present invention provides a means for generating a curved current with respect to temperature that is much simpler than prior art approaches. The percentage of current that is non-linear in terms of the total output current is relatively high.

The circuit 10 depicted in FIG. 1 provides a means of generating a curved output with respect to temperature, as depicted in FIG. 2, wherein the parabolic curve 40 shows the non-linear variation of current with respect to temperature. The output current i in FIG. 2 can have a certain inflection point within the range of −50° C. and +200° C.

In FIG. 1, the two transistors 12, 14 operate as a differential pair. The emitter current in the differential pair has a negative temperature coefficient. The emitter current is generated by using two diodes to bias the base voltage of the transistors 12, 14 to set that current.

The voltage applied between the bases 25, 37 is a negative temperature coefficient voltage. Setting the voltage between bases 25, 37 at approximately 20 mV, provides a parabolic output current from one of the transistors, which is depicted in FIG. 2 as curve 40.

Figure 3:
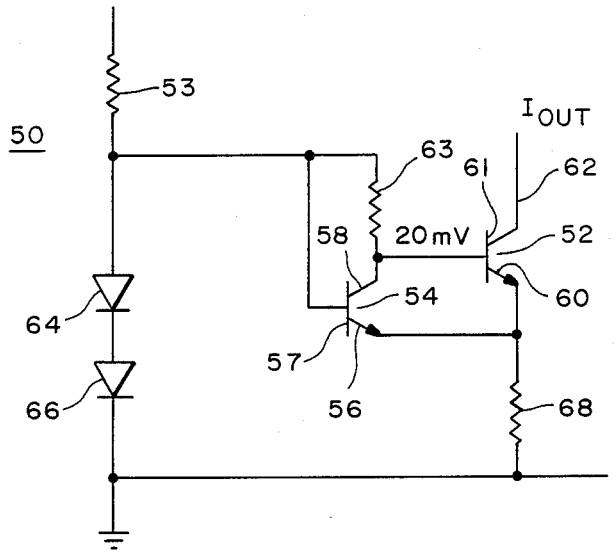
FIGS. 3-5 depict alternative embodiments of the present invention.

FIG. 3 depicts another preferred embodiment of a non-linear temperature generator circuit 50. In FIG. 3, transistor 52 includes collector 62, base 61 and emitter 60. Resistor 68 provides a similar voltage divider function as resistor 34 of FIG. 1. Diodes 64, 66 provide the same functions as diodes 20, 22 of FIG. 1.

The variation in FIG. 3 is providing a second transistor 54 having emitter 56, base 57, collector 58, wherein the collector 58 is electrically connected in common to base 61 of transistor 52.

Resistor 63 provides for the appropriate setting of a voltage between bases 57 and 61, which again is desirably approximately 20 mV.

The variation in FIG. 3 effectively provides a diode to replace one of the transistors of the differential pair of FIG. 1. Again, the common biasing current for both the transistor and diode in FIG. 3 has a negative temperature coefficient, and the voltage applied between the bases has a negative temperature coefficient.

Figure 4:
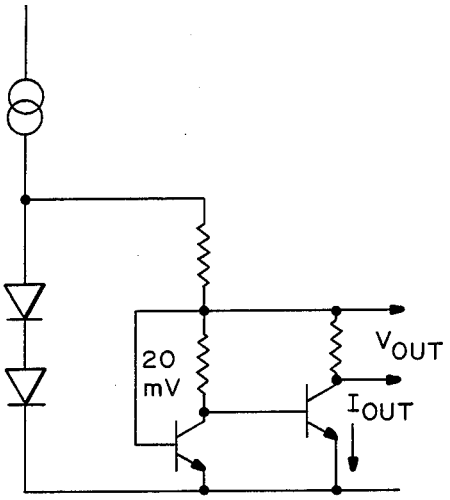
Figure 5:
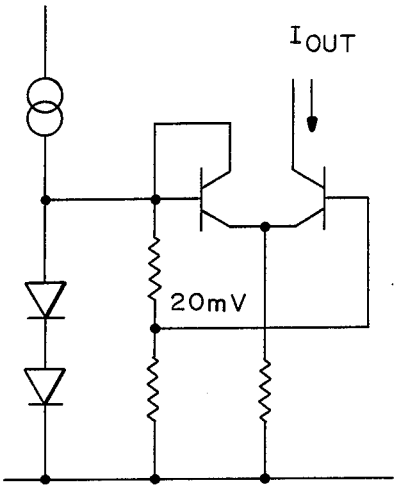

FIGS. 4 and 5 depict alternative embodiments of non-linear current generation circuits which provide similar capabilities as for those circuits depicted in FIGS. 1 and 3.

While the invention has been described with reference to specific embodiments, the description is illustrative of the inventon and not to be construed as limiting the invention. It should be pointed out that the present invention distinguishes over prior art differential amplifiers by providing a temperature sensitive circuit having a non-linear output current with respect to temperature, where the output current has an inflection point which may be set to any desired temperature. Various modifications and applications may occur to those skilled in the art, such as the use of a transistor pair (either NPN or PNP type transistors) or a transistor/diode, without departing fro the true spirit and scope of the invention as defined by the appended claims.

What is claimed is:

1. A non-linear current generation circuit comprising at least a pair of semiconductor elements electrically connected to a common biasing current having a negative temperature coefficient and a negative temperature coefficient voltage applied between said semiconductor elements so as to generate from one of said elements a non-linear output current or voltage with respect to temperature where said non-linear output current has an inflection point.

2. A circuit as in claim 1 wherein said pair of semiconductor elements include a pair of transistors.

3. A circuit as in claim 1 wherein said pair of semiconductor elements include a transistor and a diode.

4. A non-linear current generation circuit comprising at least a pair of transistors electrically connected to a common biasing current having a negative temperature coefficient, and a negative temperature coefficient voltage applied between the bases of said transistors so as to generate from one of said transistors a non linear output current or voltage with respect to temperature where said output has an inflection point.

5. A non-linear generation correction circuit comprising a diode and a transistor electrically connected to a common biasing current having a negative temperature coefficient, and a negative temperature coefficient voltage applied between said transistor and said diode so as to generate a non-linear output current with respect to temperature where said output current has an inflection point.

6. A non-linear generation correction circuit comprising a pair of transistors, each of said transistors including a collector, a base and an emitter, where the transistors are electrically connected to a common biasing current having a negative temperature coefficient, and a negative temperature coefficient voltage applied between the bases of said transistors, so as to generate from one of said transistors a non-linear output current with respect to temperature where said output current has an inflection point.

7. A circuit as in claim 6 wherein said negative temperature coefficient voltage is between 15 and 30 millivolts at 25° C.

8. A circuit as in claim 6 wherein one of said transistors is electrically connected to effectively form a diode.

9. A circuit as in claim 6 wherein said non-linear output current has an inflection point within the range of −50° C. and +200° C.

* * * * *